US010520196B2

(12) United States Patent
Okazaki et al.

(10) Patent No.: US 10,520,196 B2
(45) Date of Patent: Dec. 31, 2019

(54) CROSS FIRE TUBE WITH GUIDE RING AND ANGLED COOLING HOLES

(71) Applicant: Mitsubishi Hitachi Power Systems, Ltd., Nishi-ku, Yokohama (JP)

(72) Inventors: Hirofumi Okazaki, Yokohama (JP); Hirokazu Takahashi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 207 days.

(21) Appl. No.: 15/671,793

(22) Filed: Aug. 8, 2017

(65) Prior Publication Data

US 2018/0045416 A1 Feb. 15, 2018

(30) Foreign Application Priority Data

Aug. 9, 2016 (JP) ..... 2016-156416

(51) Int. Cl.
*F23R 3/48* (2006.01)
*F23R 3/08* (2006.01)

(52) U.S. Cl.
CPC ..... *F23R 3/48* (2013.01); *F23R 3/08* (2013.01); *F23R 2900/03044* (2013.01)

(58) Field of Classification Search
CPC ..... F23R 3/48; F23R 3/08; F23R 2900/03044
See application file for complete search history.

(56) References Cited

U.S. PATENT DOCUMENTS 5,402,635 A * 4/1995 Smith ..... F23R 3/48 60/39.37
6,334,294 B1 * 1/2002 Belsom ..... F23R 3/48 60/39.37

(Continued)

FOREIGN PATENT DOCUMENTS

CN 102022752 A 4/2011
EP 2 617 964 A2 7/2013

(Continued)

OTHER PUBLICATIONS

Korean-language Office Action issued in counterpart Korean Application No. 10-2017-0098493 dated Aug. 29, 2018 with English translation (11 pages).

(Continued)

*Primary Examiner* — Jason H Duger
*Assistant Examiner* — Todd N Jordan
(74) *Attorney, Agent, or Firm* — Crowell & Moring LLP

(57) ABSTRACT

The present invention provides a multi-can type gas turbine combustor including a plurality of combustors that mix and burn fuel and the air, the combustors being connected by a crossfire tube assembly. The gas turbine cools the crossfire tube assembly without lowering the temperature of a combustion exhaust gas passing through the crossfire tube assembly and prevents thermal deformation and fire damage of the crossfire tube assembly. In a gas turbine according to the present invention, a guide ring that guides a current of the air is provided in a position opposed to air holes. One side end portion of an annular space configured between the guide ring and a crossfire tube assembly is opened to a space on the inside of the crossfire tube assembly. The other end portion is a closed end connected to a partition wall configuring the crossfire tube assembly. The length of an annular space between the air holes and the closed end is set to three times or more as large as the diameter of the air holes. Further, a part of the air holes is drilled to tilt to the closed end of the annular space to cool the crossfire tube assembly including the guide ring with a small cooling air amount.

9 Claims, 9 Drawing Sheets

(56) References Cited

U.S. PATENT DOCUMENTS

| | | | | |
|---|---|---|---|---|
| 8,220,246 | B2 * | 7/2012 | Widener | F23R 3/48 60/39.37 |
| 8,959,925 | B2 * | 2/2015 | Romig | F02C 7/262 60/776 |
| 2003/0188537 | A1 | 10/2003 | Martling et al. | |
| 2010/0107645 | A1 | 5/2010 | Kollati | |
| 2011/0067406 | A1 | 3/2011 | Widener | |
| 2015/0204543 | A1 | 7/2015 | Kishida et al. | |
| 2016/0003481 | A1 | 1/2016 | Taniguchi et al. | |
| 2017/0284680 | A1 * | 10/2017 | Okazaki | F23R 3/48 |
| 2019/0137106 | A1 * | 5/2019 | Okazaki | F23R 3/48 |

FOREIGN PATENT DOCUMENTS

| | | | |
|---|---|---|---|
| EP | 3 032 176 | A1 | 6/2016 |
| JP | 10-339440 | A | 12/1998 |
| JP | 11-14056 | A | 1/1999 |
| JP | 2010-106829 | A | 5/2010 |
| KR | 10-2015-0110757 | A | 10/2015 |
| WO | WO 2016/025054 | A2 | 2/2016 |

OTHER PUBLICATIONS

Chinese-language Search Report issued in counterpart Chinese Application No. 2017106717933 dated Dec. 20, 2018 with partial English translation (three (3) pages).

Korean-language Notice of Final Rejection issued in counterpart Korean Application No. 10-2017-0098493 dated Feb. 27, 2019 with English translation (eight (8) pages).

Extended European Search Report issued in counterpart European Application No. 17182231.5 dated Nov. 28, 2017 (five pages).

* cited by examiner

CROSS FIRE TUBE WITH GUIDE RING AND ANGLED COOLING HOLES

CLAIM OF PRIORITY

The present application claims priority from Japanese Patent application serial no. 2016-156416, filed on Aug. 9, 2016, the content of which is hereby incorporated by reference into this application.

TECHNICAL FIELD

The present invention relates to a structure of a gas turbine combustor and, more particularly, to a combustor structure of a multi-can type gas turbine including a plurality of combustors that mix and burn fuel and the air, the combustors being connected by a crossfire tube assembly.

BACKGROUND ART

There is a form called multi-can type gas turbine including multi-can type gas turbine combustors (hereinafter described as combustors) with respect to one gas turbine. Usually, in the multi-can type combustor, the combustors are annularly disposed around the gas turbine, an ignitor is set in one or several combustors, and the other remaining combustors do not include individual ignitors. Ignition of the combustors not including the ignitors is carried out through a pipe that connects the combustors adjacent to one another called crossfire tube assembly. When the gas turbine is started, a system for first igniting the combustor(s) in which the ignitor(s) is (are) set and igniting the adjacent combustors via the crossfire tube assembly to ignite all the combustors is adopted.

In general, the crossfire tube assembly is configured by a double pipe of an inner tube and an outer tube. The inner tube connects combustion chambers of the adjacent combustors, circulates a high-temperature combustion exhaust gas, and performs flame propagation. The outer tube is provided on the outer circumference side of the inner tube, connects channels of the air for fuel of the adjacent combustors, and reduces a pressure difference between an inner tube inner side and an inner tube outer side to play a role of protecting the inner tube.

The crossfire tube assembly is a constituent component necessary for the ignition operation explained above and needs to surely carry out the ignition. Since the crossfire tube assembly is exposed to the high-temperature combustion exhaust gas, prevention of thermal deformation and fire damage needs to be examined. A method of positioning in combining the combustors, a method of coping with deformation, and the like also need to be examined.

As the background art of this technical field, for example, there are techniques disclosed in Patent Document 1 to Patent Document 3. Patent Document 1 discloses a technique for cooling a crossfire tube assembly and preventing fire damage. Patent Document 2 discloses a positioning method in connecting combustors and a technique for cooling a crossfire tube assembly and preventing fire damage. Patent Document 3 discloses a technique for diffusing, with a plurality of flow disseminators provided with respect to a plurality of cooling holes provided in a combustor section, which is a partition wall configuring a combustion chamber of a combustor, to be aligned with the cooling holes, cooling air flowing through the cooling holes.

PRIOR ART DOCUMENT

Patent Document

[Patent Document 1] JP-A-10-339440
[Patent Document 2] JP-A-11-14056
[Patent Document 3] JP-A-2010-106829

DISCLOSURE OF THE INVENTION

Problems that the Invention is to Solve

The crossfire tube assembly feeds the combustion exhaust gas to the combustors before ignition to ignite the combustors making use of a pressure difference that occurs between the combustors after ignition completion and the combustors before ignition adjacent to the combustors. If the ignition ends in all the combustors and air amounts, fuel amounts, and pressures of the respective combustors are the same, there is no pressure difference between the combustors and there is no current of the combustion exhaust gas that circulates in the crossfire tube assembly. In this case, a time in which the high-temperature combustion exhaust gas circulates in the crossfire tube assembly is only a short time during the ignition.

However, actually, fluctuation occurs in the air amounts, the fuel amounts, the pressures, and combustion states in each of the combustors. Therefore, in some case, a pressure difference occurs between the adjacent combustors and the high-temperature combustion exhaust gas continues to circulate through the crossfire tube assembly. At this point, the crossfire tube assembly continues to be exposed to the high-temperature combustion exhaust gas to have high temperature. Therefore, the crossfire tube assembly needs to be cooled for prevention of thermal deformation and fire damage of the crossfire tube assembly.

As one of methods of cooling the crossfire tube assembly, there is a method of guiding a part of the combustion air having temperature lower than the temperature of the high-temperature combustion exhaust gas into the crossfire tube assembly through holes (air holes) provided in the crossfire tube assembly to cool the crossfire tube assembly. The wall surface of the inner tube is cooled by causing the combustion air in the outer tube to flow into the inner tube from the air holes provided on the wall surface of the inner tube of the crossfire tube assembly.

When cooling the wall surface of the inner tube, if a guide ring having a circular shape concentric with the inner tube is provided in a position opposed to the axial direction of the air holes in the inner tube inside, one end face is closed, and an end face on one side is opened to the inner tube inside, the air flowing in from the air holes flows along the inner circumferential wall surface of the inner tube from the open end face of the guide ring. Since the low-temperature cooling air flows along the inner tube wall surface, it is possible to prevent the inner tube wall surface from being exposed to the high-temperature combustion exhaust gas and prevent thermal deformation and fire damage of the crossfire tube assembly.

However, in the configuration explained above, the inner circumference side of the guide ring is exposed to the current of the high-temperature combustion exhaust gas. The guide ring is cooled by a so-called impingement effect at the time when the air circulating from the air holes collides with the outer circumference side of the guide ring. However, a cooling range of the air is limited to the peripheries of the air holes. In particular, the air less easily flows on the closed end side where an end portion is closed in an annular space between the inner tube and the guide ring. Therefore, the temperature of the guide ring rises. There is a risk of thermal deformation and fire damage.

To lower the temperature of the guide ring, there are a method of increasing the sectional area of the air holes to increase a cooling air amount and a method of reducing the length of the guide ring to narrow a range exposed to the current of the high-temperature combustion exhaust gas. However, in the method of increasing the cooling air amount, it is likely that the temperature of the combustion exhaust gas passing through the crossfire tube assembly is lowered during ignition of the gas turbine combustor to hinder flame propagation. In the method of reducing the length of the guide ring, an effect of the current of the air being guided by the guide ring decreases and the cooling range of the inner tube is narrowed. There is a problem in that positions where the air holes are provided are limited and machining cost increases.

The present invention has been devised in view of the problems and an object of the present invention is to provide a multi-can type gas turbine including a plurality of combustors. The gas turbine cools a crossfire tube assembly without lowering the temperature of a combustion exhaust gas passing through the crossfire tube assembly during ignition of a gas turbine combustor and prevents thermal deformation and fire damage of the crossfire tube assembly.

Means for Solving the Problems

In order to solve the problem, a gas turbine according to the present invention is a multi-can type gas turbine including a plurality of combustors. The gas turbine is applied to a form in which the combustors adjacent to one another are connected by a crossfire tube assembly and the combustors are ignited by flame propagation. Further, the crossfire tube assembly is configured by a double pipe and configured by an inner tube that connects combustion chambers of the adjacent combustors and an outer tube that covers the inner tube and connects combustion air channels of the adjacent combustors. Further, holes (air holes) for introducing the air into the inside are provided in the inner tube. A guide ring having a circular shape concentric with the inner tube is provided in a position opposed to the axial direction of the air holes. One end face is closed and an end face on one side (the other end face) is opened to the inner tube inside.

In the gas turbine including the crossfire tube assembly having the configuration explained above, a part of the air holes is drilled toward the closed end side.

Besides changing the drilling direction of the air holes, an obstacle for suppressing the air supplied from the air holes from flowing and guiding the air to the closed end face may be provided in a position opposed to the air holes on the outer circumference side of the guide ring.

Note that, in the gas turbine including the crossfire tube assembly having the configuration explained above, an annular space may be provided between a partition wall of the inner tube and the guide ring. The annular space on the closed end side may be expanded to set the distance between the air holes and the closed end to be three times or more as large as the diameter of the air holes.

Advantages of the Invention

According to the present invention, it is possible to facilitate cooling of the crossfire tube assembly under a condition in which an amount of cooling air circulated into the inner tube of the crossfire tube assembly for cooling is small. Therefore, it is possible to suppress, during ignition of the gas turbine combustor, the temperature of a high-temperature combustion exhaust gas passing through the crossfire tube assembly from falling because of mixing with the cooling air and surely carry out flame propagation between the combustors. It is possible to prevent thermal deformation and fire damage of the crossfire tube assembly through the cooling of the crossfire tube assembly.

In the present invention, the guide ring having the circular shape concentric with the inner tube is provided in the position opposed to the axial direction of the air holes provided in the inner tube, the one end face is closed, and the end face on the one side is opened to the inner tube inside. Then, the air flowing in from the air holes flows along the inner circumferential wall surface of the inner tube from the opened end face of the guide ring. Since the low-temperature cooling air flows along the inner tube wall surface, it is possible to prevent the crossfire tube assembly from being exposed to the high-pressure combustion exhaust gas and prevent thermal deformation and fire damage of the crossfire tube assembly.

In this case, a part of the air holes is drilled toward the closed end side to forcibly feed a part of the air to the closed end side and cause a current of the air on the closed end side to facilitate the cooling of the guide ring. Since drilling directions of the air holes are different for each of the holes, a range cooled by a so-called impingement effect at the time when the air circulating from the air holes collides with the outer circumference side of the guide ring expands to the axial direction of the guide ring. Therefore, the guide ring is easily cooled. The inner circumference side of the guide ring is exposed to the high-temperature combustion exhaust gas. However, since the range cooled by the impingement effect on the outer circumference side of the guide ring expands and the current of the air on the closed end side is generated, it is possible to prevent thermal deformation and fire damage of the crossfire tube assembly including the guide ring with a small air amount.

When the obstacle for guiding the air supplied from the air holes to the closed end face is provided in the position opposed to the air holes on the outer circumference side of the guide ring, the same effect is obtained. That is, by guiding a part of the air to the closed end side with the obstacle, a current of the air is caused on the closed end side to facilitate cooling of the guide ring. The range cooled by the so-called impingement effect at the time when the air circulating from the air holes collides with the outer circumference side of the guide ring expands to the closed end side of the guide ring. Therefore, it is possible to prevent thermal deformation and fire damage of the crossfire tube assembly including the guide ring with a small air amount.

Note that, in the annular space between the partition wall of the inner tube and the guide ring, if the distance between the air holes and the closed end is set to three times or more as large as the diameter of the air holes, the air flowing to the closed end side in the air flowing in from the air holes easily reverses and flows out from the open end side. Therefore, an amount of the air flowing to the closed end side increases. It is easy to cool the closed end side of the guide ring.

Problems, configurations, and effects other than these explained above are clarified by the following explanation of embodiments.

BEST MODE FOR CARRYING OUT THE INVENTION

Figure 1:
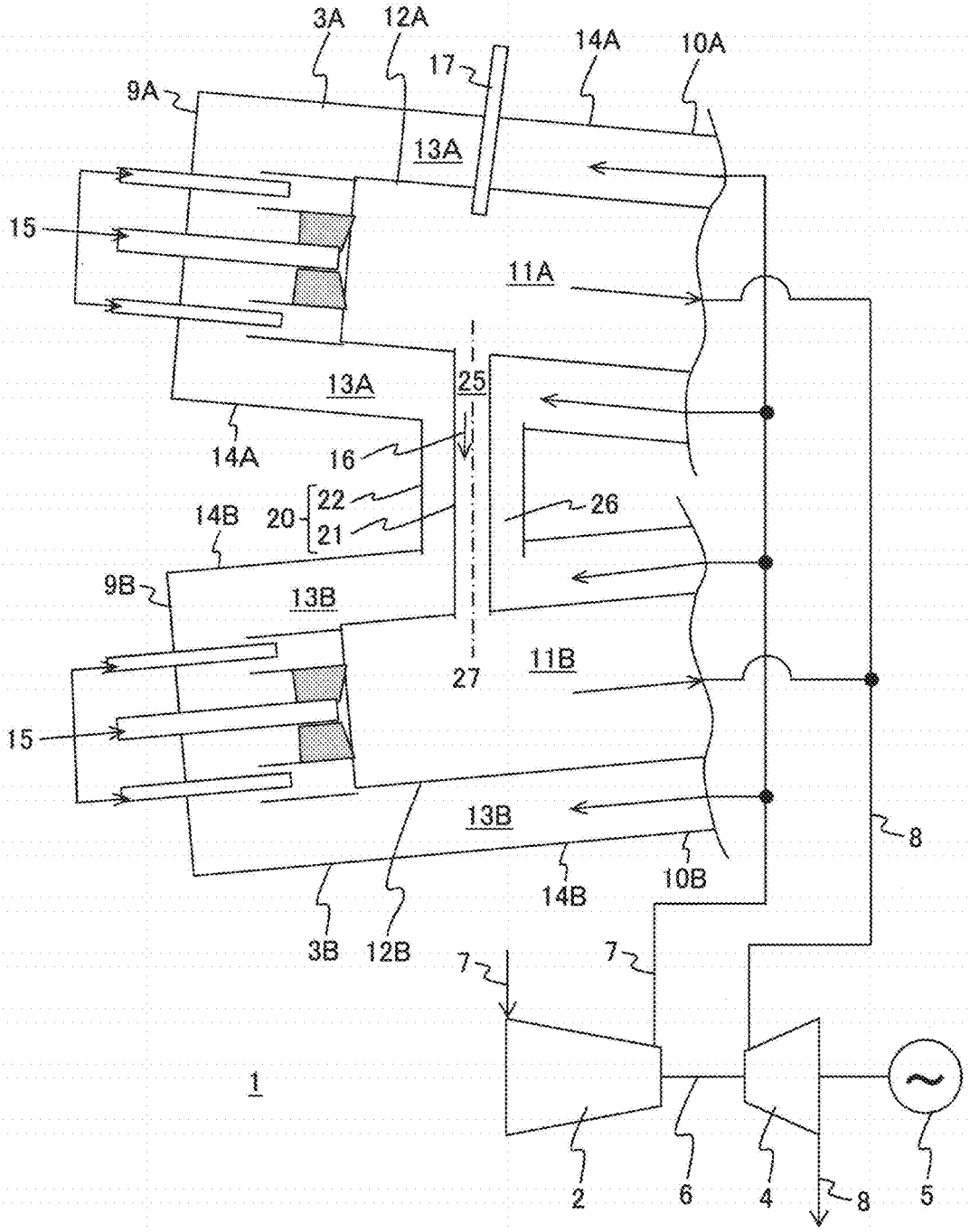
FIG. 1 is a schematic diagram showing a schematic configuration of a gas turbine combustor according to an embodiment of the present invention.

Gas turbines according to embodiments of the present invention are explained below with reference to the drawings. Note that, in the explanation, the same reference numerals and signs are used for the same components and explanation of the components is sometimes omitted.

[First Embodiment]

Figure 2:
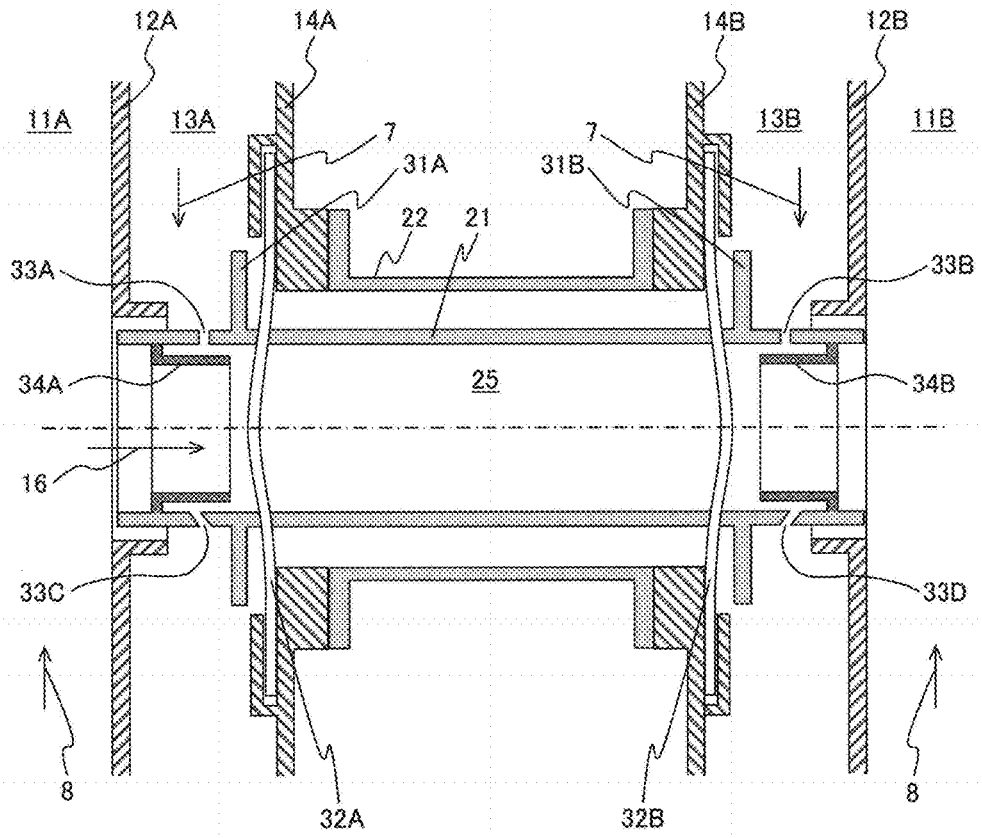
FIG. 2 is a schematic diagram showing the configuration of a crossfire tube assembly in the gas turbine combustor shown in FIG. 1.
Figure 3A:
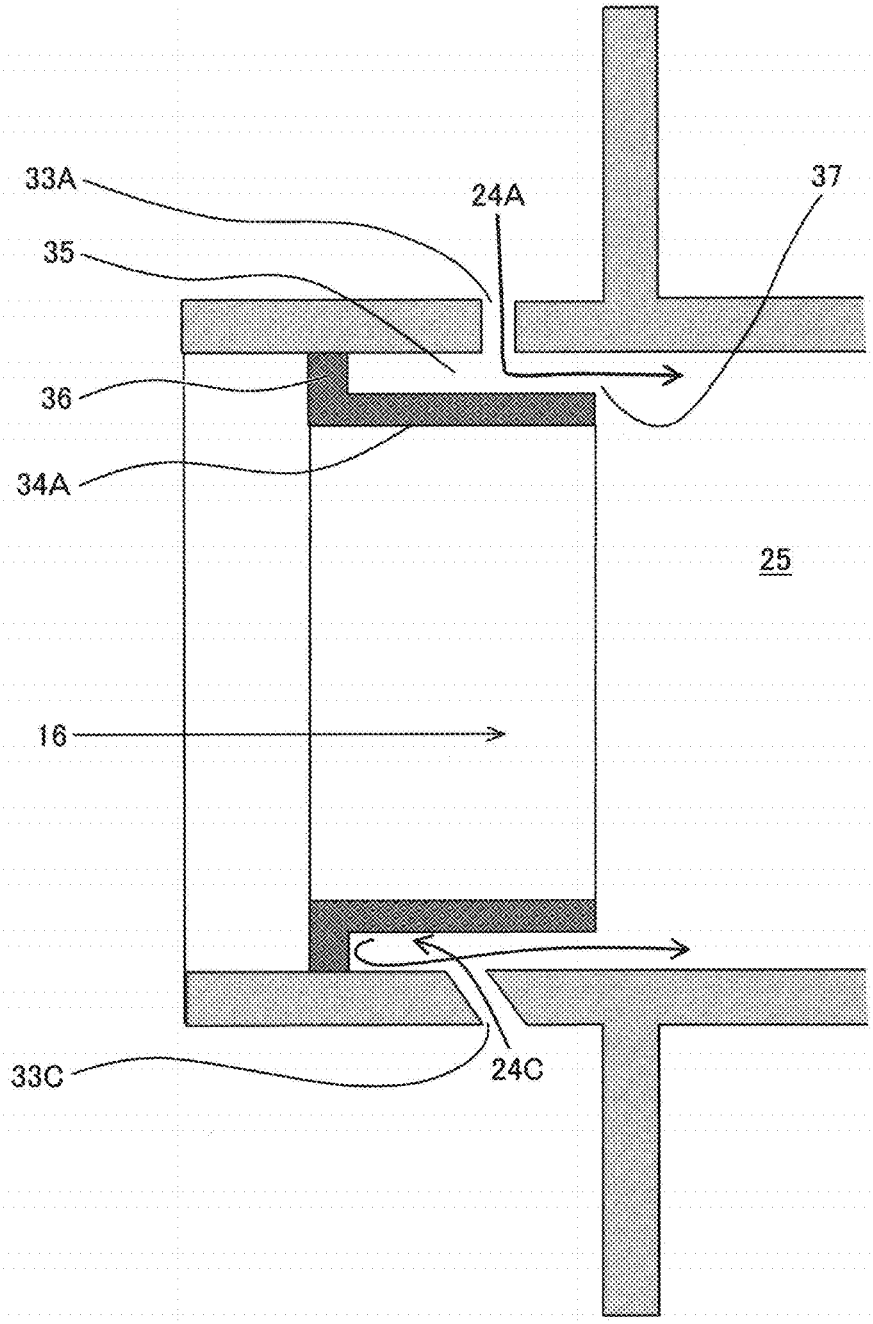
FIG. 3A is a schematic diagram showing the configuration of air holes for cooling in the crossfire tube assembly shown in FIG. 2.
Figure 3B:
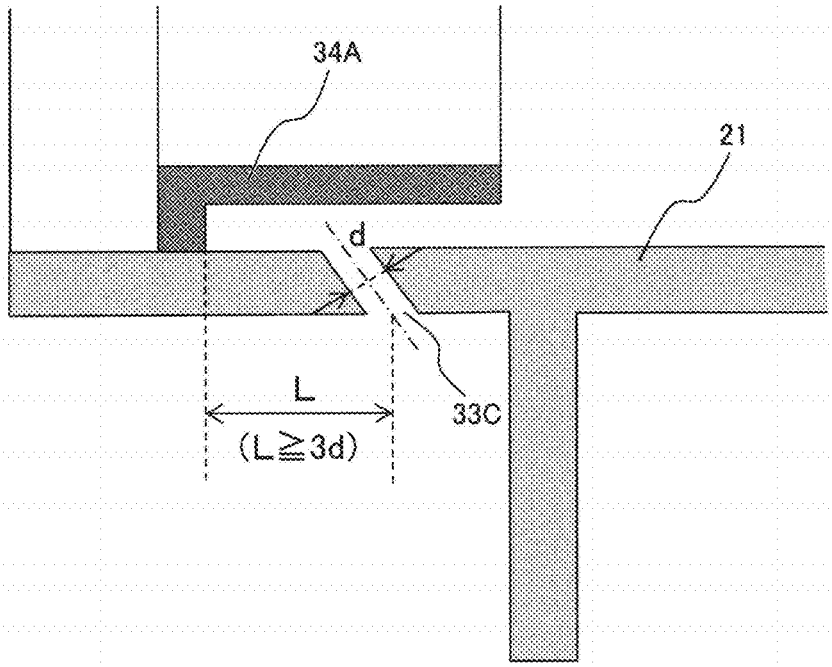
FIG. 3B is a schematic diagram showing a positional relation between (dimensions of) a part of the air holes for cooling and a guide ring shown in FIG. 3A.
Figure 4:
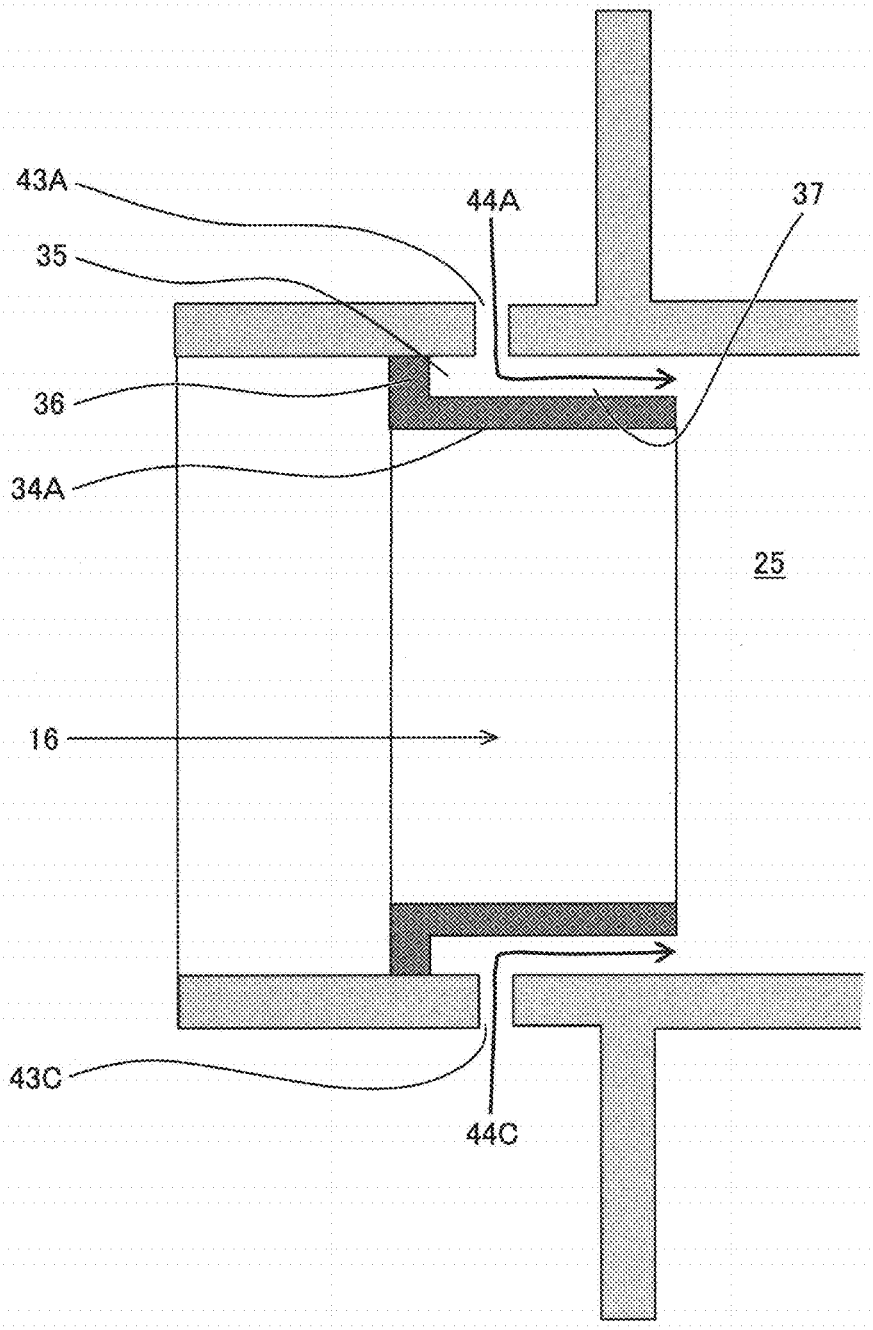
FIG. 4 is a schematic diagram showing the configuration of air holes for cooling of a conventional crossfire tube assembly in comparison with the crossfire tube assembly according to the embodiment of the present invention shown in FIG. 3A.

A gas turbine according to a first embodiment of the present invention is explained with reference to FIG. 1 to FIG. 4. FIG. 1 shows apart of the gas turbine according to the first embodiment of the present invention. FIG. 2 shows the configuration of a crossfire tube assembly shown in FIG. 1. FIG. 3A shows the vicinity of air holes of the crossfire tube assembly shown in FIG. 1 and FIG. 2. FIG. 3B is an enlarged diagram showing the vicinity of a guide ring 34A and an air hole 33C shown in FIG. 3A. FIG. 4 is a partial diagram of a crossfire tube assembly in a conventional example compared with the present invention. FIG. 4 is explained in comparison with FIG. 3A.

First, a role and a problem of the crossfire tube assembly are explained with reference to FIG. 1 and FIG. 2. Then, a difference between content of the first embodiment of the present invention and the conventional example is explained with reference to FIG. 3 and FIG. 4.

In FIG. 1, a gas turbine 1 is configured by a compressor 2, combustors 3A and 3B, a turbine 4, and a generator 5. A drive shaft 6 connects the compressor 2, the turbine 4, and the generator 5. Air (combustion air) 7 compressed by the compressor 2 is mixed with fuel 15 by the combustors 3A and 3B to burn and change to a high-temperature and high-pressure combustion exhaust gas 8. Energy is collected by the turbine 4. Electric power is generated by the generator 5.

The combustor head portions 9A and 9B of the combustors 3A and 3B are disposed on the compressor 2 side. The combustor tail portions 10A and 10B of the combustors 3A and 3B are disposed on the turbine 4 side. The combustors 3A and 3B are configured by combustion chambers 11A and 11B, partition walls (liners) 12A and 12B configuring the combustion chambers, combustion air channels 13A and 13B, and outer circumferential partition walls 14A and 14B in order from the center side toward the outer circumference side. The combustion air 7 discharged from the compressor 2 reverses (turns) a flowing direction at the combustor tail portions 10A and 10B of the combustors, passes through the combustion air channels 13A and 13B, and flows to the combustor head portions 9A and 9B of the combustors.

The combustion air 7 reverses (turns) the flowing direction again at the combustor head portions 9A and 9B of the combustors and is mixed with the fuel 15 supplied from the outside at the combustor head portions 9A and 9B to burn in the combustion chambers 11A and 11B. The combustion exhaust gas 8 flows into the turbine 4 from the combustor tail portions 10A and 10B of the combustors.

Note that, to simplify explanation, two combustors are shown in FIG. 1. However, the same applies when the gas turbine 1 includes three or more combustors. In FIG. 1, the compressor 2, the turbine 4, and the generator 5 are connected to one drive shaft 6. However, a drive shaft can also be divided into a plurality of drive shafts and provided. The drive shaft 6 can also be used for driving of another rotating body instead of the generator 5.

In the gas turbine shown in FIG. 1, an ignitor 17 is provided in the combustor 3A. A crossfire tube assembly 20 is connected between the combustors 3A and 3B. The crossfire tube assembly 20 is configured by a double pipe of an inner tube 21 and an outer tube 22. The inner tube 21 connects the partition walls (the liners) 12A and 12B. A combustion exhaust gas 16 in the combustion chambers 11A and 11B can circulate in the inner tube 21. The outer tube 22 is connected to the outer circumferential partition walls 14A and 14B of the combustion air channels 13A and 13B. The combustion air 7 can circulate in the outer tube 22.

During ignition of the gas turbine, a mixture of the fuel 15 and the combustion air 7 in the combustion chamber 11A is ignited by the ignitor 17 set in the combustor 3A. Pressure in the combustion chamber 11A is increased by generation of a combustion exhaust gas. However, since ignition is not performed in the combustion chamber 11B yet, pressure in the combustion chamber 11B is low. Therefore, the high-temperature combustion exhaust gas 16 is sent into the combustion chamber 11B from the combustion chamber 11A through the inner tube 21 that connects the combustion chambers 11A and 11B. In the combustion chamber 11B, the mixture of the fuel 15 and the combustion air 7 is ignited by the high-temperature combustion exhaust gas 16 flowed through the inner tube 21. The combustors adjacent to each other via the crossfire tube assembly 20 are sequentially ignited, whereby all the combustors can be ignited.

If air amounts, fuel flow rates, and pressures of the respective combustors are the same, there is no pressure difference between the combustors when the ignition ends in all the combustors. In this case, there is no current of the high-temperature combustion exhaust gas 16 circulating in the inner tube 21 of the crossfire tube assembly 20. Time in which the high-temperature combustion exhaust gas 16 circulates in the inner tube 21 is only a short time during the ignition. However, actually, fluctuation sometimes occurs in the air amounts, the fuel flow rates, the pressures, and combustion states in each of the combustors. In this case, the high-temperature combustion exhaust gas 16 sometimes continues to circulate in the inner tube 21 according to a pressure difference between the adjacent combustors 3A and 3B. The inner tube 21 has high temperature because the high-temperature combustion exhaust gas 16 circulates.

Deformation and damage easily occur in operation for a long time. The inner tube 21 needs to be cooled for prevention of the deformation and the damage.

Details of the crossfire tube assembly are shown in FIG. 2. Stoppers 31A and 31B for positioning are attached to the inner tube 21 of the crossfire tube assembly shown in FIG. 2. The inner tube 21 is positioned by combining the stoppers 31A and 31B with retainers 32A and 32B. In general, the retainers 32A and 32B are elastic bodies. Even if thermal deformation and vibration occur during the operation of the gas turbine, displacement is absorbed by the elastic bodies. The inner tube 21 is fixed to the combustors while stress generated in the inner tube 21 of the crossfire tube assembly is reduced.

In the inner tube 21 of the crossfire tube assembly, air holes 33 (33A to 33D) for introducing a part of the combustion air 7 into the inner tube 21 are provided. Guide rings 34A and 34B are respectively provided in positions opposed to the axial direction of the air holes 33 (33A to 33D).

The configuration of the vicinity of the air holes 33A and 33C is shown in FIG. 3A. The guide rings 34A and 34B are cylinders having a circular shape concentric with the inner tube 21. The guide rings 34A and 34B configure annular spaces 35 between the guide rings 34A and 34B and the inner tube 21. One side (one end portion) of the guide ring 34A is connected to a partition wall configuring the inner tube 21 to be a closed end 36. The other side (the other end) of the guide ring 34A is an open end 37 connected to a space 25 of the inner tube 21. A plurality of air holes 33 (33A to 33D) are provided in the circumferential direction of the inner tube 21. In FIG. 3A, two holes 33A and 33C among the air holes 33 are shown. The hole 33A on the upper side is drilled in the radial direction of the inner tube 21. The hole 33C on the lower side is drilled to tilt toward the closed end 36. On the other hand, in FIG. 4 showing a conventional example compare with FIG. 3, both of air holes 43A and 43C are drilled in the radial direction of the inner tube 21.

In the conventional example shown in FIG. 4, first, currents 44A and 44C of the air flowing into the inner tube 21 from air holes 43 (43A and 43C) collide with the outer circumferential surface of the guide ring 34A opposed to the air holes. A flowing direction changes toward the open end 37 and the currents 44A and 44C of the air flow into the inner tube 21. A layer of the currents 44A and 44C of the air is formed between a current of a high-temperature gas (the combustion exhaust gas 16) in the inner tube 21 and the inner tube 21 of the crossfire tube assembly to suppress heat transfer from the current of the high-temperature gas (the combustion exhaust gas 16) to the inner tube 21 of the crossfire tube assembly and suppress a temperature rise of the inner tube 21. Such a cooling system is called film cooling because the currents 44A and 44C of the air are formed in a film shape along the inner wall of the inner tube 21.

The outer surface of the guide ring 34A is cooled by the current of the air. On the other hand, the inner circumference side of the guide ring 34A is heated by the current of the high-temperature gas (the combustion exhaust gas 16). Therefore, cooling from the outer surface needs to be facilitated as in the inner tube 21. When being cooled by the currents 44A and 44C of the air, so-called impingement cooling for obtaining high cooling performance according to collision of the current of the air acts on the outer circumferential surface of the guide ring 34A opposed to the air holes 43A and 43C.

Cooling by the currents 44A and 44C of the air strongly works from the air holes 43A and 43C toward the open end 37. On the other hand, on the closed end 36 side from the air holes 43A and 43C, the cooling less easily works because the closed end 36 side is away from the currents 44A and 44C of the air. The temperature of the guide ring 34A rises. That is, in the conventional example shown in FIG. 4, the currents 44A and 44C of the air less easily flow to the closed end 36 side. Therefore, the temperature on the closed end 36 side of the guide ring 34A sometimes rises.

Therefore, it is desirable to narrow a space on the closed end 36 side of the annular space 35. However, when fixing of the guide rings 34 (34A and 34B) and adjustment of the positions of the guide rings 34 and the air holes 43 (43A to 43D) are taken into account, a space is formed on the closed end 36 side of the annular space 35. When it is attempted to narrow the space, more machining accuracy is required for the fixing of the guide rings 34 and the adjustment of the positions of the guide rings 34 and the air holes 43 (43A to 43D) and cost increases. Therefore, the closed end 36 side of the annular space 35 usually has length twice to three times of the diameter of the air holes 43. The temperature on the closed end 36 side of the guide rings 34 sometimes rises.

On the other hand, in the first embodiment of the present invention shown in FIG. 3A, as shown in FIG. 3A, among the air holes 33, the hole 33A on the upper side is drilled in the radial direction of the inner tube 21 and the hole 33C on the lower side is drilled to tilt toward the closed end 36. The drilling direction is changed for each of the air holes 33. For example, the holes 33A and 33C are alternately formed in the circumferential direction of the inner tube 21.

The air flowing in from the air hole 33C drilled to tilt with respect to the inner tube 21 has a flow velocity component directed toward the closed end 36 side according to the shape of the air hole. Therefore, the air once flows to the closed end 36 side, circulates in the annular space 35 near the closed end 36, and is thereafter discharged to the space 25 in the inner tube from the open end 37. A portion on which so-called impingement cooling for obtaining high cooling performance according to collision of the current of the air acts expands to the closed end 36 side of the air hole 33C. In this embodiment, by changing the drilling direction of the air holes, the portion on which the impingement cooling acts is formed in a wide range in the axial direction of the inner tube 21 centering on the air holes 33. Since a current 24C of the air flows to the closed end 36 side, a portion cooled by the current 24C of the air flowing in from the air holes expands to the annular space 35.

Since a cooling range on the outer surface of the guide ring 34A expands, it is possible to cool the crossfire tube assembly including the guide ring 34A and reliability is improved. Since it is possible to cool the crossfire tube assembly with a smaller cooling air amount, it is possible to reduce a cooling air amount, cool the crossfire tube assembly without lowering the temperature of the combustion exhaust gas passing through the crossfire tube assembly during the ignition, and prevent thermal deformation and fire damage of the crossfire tube assembly. Since margins for the fixing of the guide ring 34A and the adjustment of the positions of the guide ring 34A and the air holes 33 (33A to 33D) are formed by the space on the closed end 36 side of the annular space 35, it is possible to suppress accuracy necessary for machining and machining cost.

In the embodiment shown in FIG. 3A, the air holes 33A and 33C having different drilling angles are alternately provided. However, the angles and the directions of the holes can be adjusted as appropriate. For example, compared to the air holes 33A, the air holes 33C, the drilling direction of which is changed, may be provided at a ratio of 2 to 1. It is important to form a current for circulating the air near the closed end 36. The effect explained above is obtained if the air hole 33C drilled toward the closed end 36 is included.

In the first embodiment of the present invention shown in FIG. 3A, as shown in FIG. 3B, length L of the space on the closed end 36 side of the air hole 33C is set to three times or more as larger as a diameter d of the air hole 33C (L≥3d). By expanding a portion between the air holes and the closed end in the annular space between the partition wall of the inner tube and the guide ring, in the air flowing in from the air holes, the air flowing to the closed end side reverses and easily flows out from the open end side. Therefore, an amount of the air flowing to the closed end side increases. It is easy to cool the closed end side of the guide ring.

Figure 5:
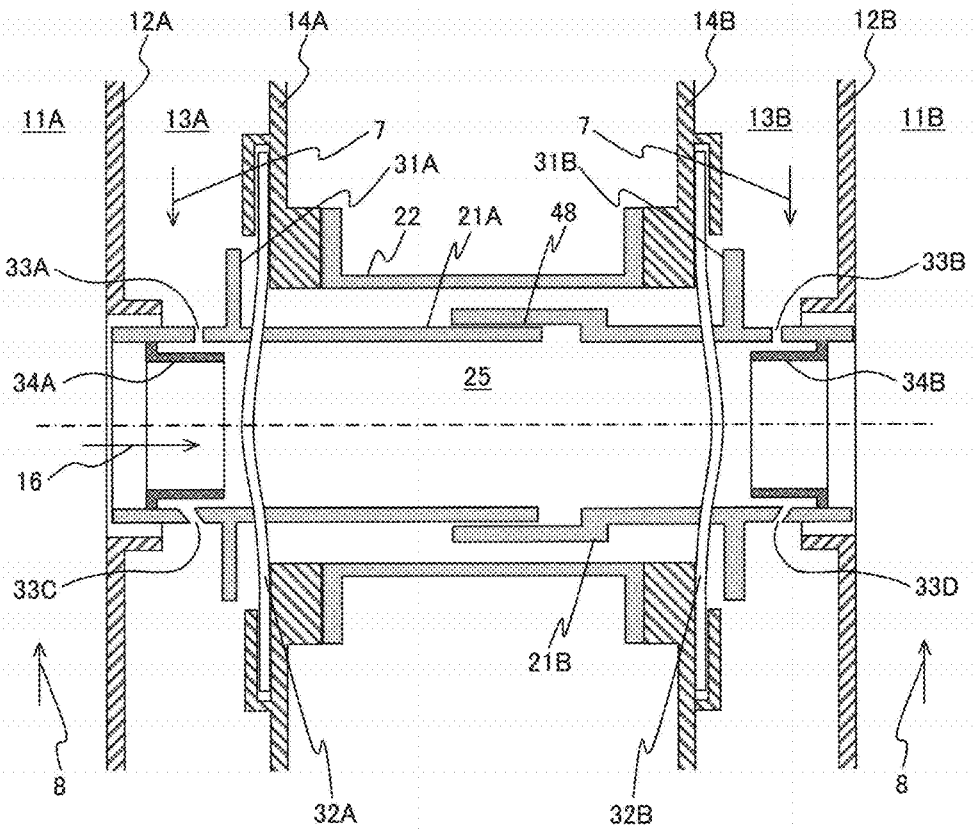
FIG. 5 is a schematic diagram showing the configuration of the crossfire tube assembly according to the embodiment of the present invention.

A modification of the crossfire tube assembly shown in FIG. 2 is shown in FIG. 5. In this embodiment shown in FIG. 1 to FIG. 3B, the one inner tube 21 is provided and the vicinities of both the ends are fixed to the outer tube 22 of the combustor. However, as shown in FIG. 5, it is also possible to divide the inner tube into inner tubes 21A and 21B and forma divided portion 48 as a fitting structure. By forming the inner tubes 21A and 21B in the fitting structure, flexibility increases with respect to thermal deformation in the axial direction of the inner tubes and fluctuation in the distance between the inner tubes and the outer tube 22. Therefore, it is possible to reduce stress acting on the inner tubes. Besides, since the length of the inner tubes decreases, assembly is easy.

As explained above, according to the first embodiment of the present invention, by combining the inner tubes in which the drilling directions of the air holes 33 are changed, it is possible to achieve both of cooling and prevention of thermal deformation and fire damage of the crossfire tube assembly and a reduction in manufacturing cost due to the easiness of the assembly.

[Second Embodiment]

Figure 6A:
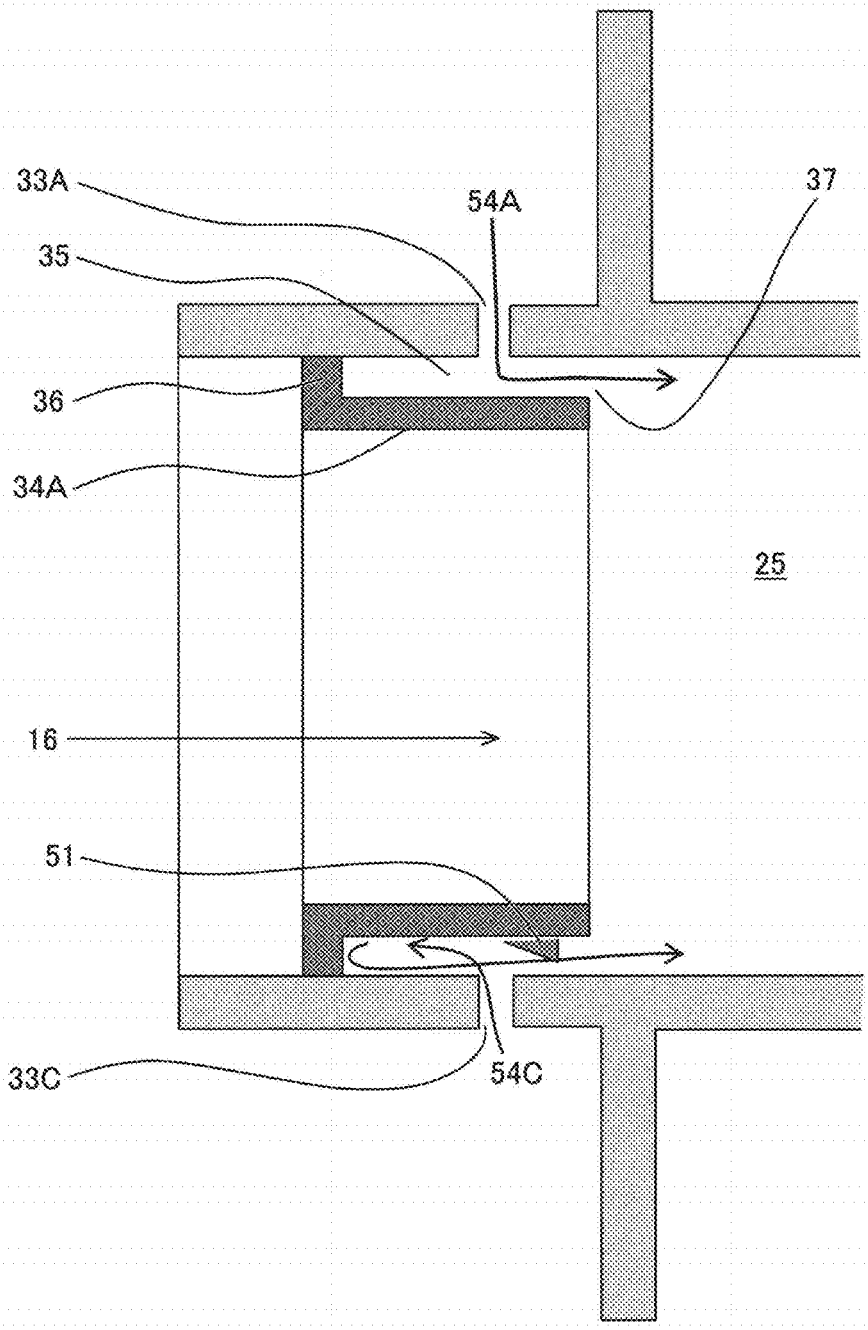
FIG. 6A is a schematic diagram showing the configuration of air holes for cooling in a crossfire tube assembly according to an embodiment of the present invention.

A gas turbine according to a second embodiment of the present invention is explained with reference to FIG. 6A. Note that the gas turbine according to the second embodiment is characterized in that, in the gas turbine according to the first embodiment explained above, an obstacle (a protrusion section) 51 is provided against a current of the air flowing in the annular space 35 in a part of the outer surface of the guide ring 34A provided in the crossfire tube assembly 20. Therefore, as shown in FIG. 6A, action of the obstacle 51 is mainly explained. The other portions are the same as the portions in the first embodiment. Therefore, detailed explanation of the portions is omitted.

The second embodiment of the present invention is characterized in that the obstacle 51 is provided on the open end 37 side of the air hole 33C. The second embodiment includes a case where, as shown in FIG. 6A, the obstacle 51 is provided in the air hole 33C, which is a part of the air holes, and is not provided in, for example, the air hole 33A.

In the air hole 33C, near which the obstacle 51 is provided, a current 54C of the air flowed into the annular space 35 is suppressed from flowing to the open end 37 side by the obstacle 51. Therefore, the current 54C of the air once flows to the closed end 36 side, circulates in the annular space 35 near the closed end 36, and is thereafter discharged from the open end 37 to the space 25 in the inner tube. A portion on which so-called impingement cooling for obtaining high cooling performance according to collision of the current of the air acts expands to the closed end 36 side of the air hole 33C. On the other hand, in the air hole 33A, near which the obstacle 51 is not provided, a current 54A of the air flowed into the annular space 35 flows into the space 25 in the inner tube from the open end 37.

As indicated by the currents 54A and 54C of the air shown in FIG. 6A, two ways of the currents of the air are formed by providing the obstacle 51 on the open end 37 side of the air hole 33C as a part of the air holes. Therefore, the portion on which the impingement cooling acts is formed in a wide range in the axial direction of the inner tube 21 centering on the air holes 33. Since the current 54C of the air flows to the closed end 36 side, a portion cooled by the air current 54C flowing in from the air holes expands to the annular space 35.

Since the cooling range on the outer surface of the guide ring 34A expands, it is possible to cool the crossfire tube assembly including the guide ring 34A and reliability is improved. Since it is possible to cool the crossfire tube assembly with a smaller cooling air amount, it is possible to reduce a cooling air amount, cool the crossfire tube assembly without lowering the temperature of the combustion exhaust gas passing through the crossfire tube assembly during the ignition, and prevent thermal deformation and fire damage of the crossfire tube assembly. Since margins for fixing of the guide ring 34A and adjustment of the positions of the guide ring 34A and the air holes 33 (33A to 33D) are formed by the space on the closed end 36 side of the annular space 35, it is possible to suppress accuracy necessary for machining and machining cost.

Further, the structure in the second embodiment of the present invention can also be applied to the crossfire tube assembly in which the inner tube is divided as shown in FIG. 5. As explained in the second embodiment of the present invention, by providing the obstacle 51 on the outer surface of the guide ring and combining the divided inner tubes shown in FIG. 5, it is possible to achieve both of cooling and prevention of thermal deformation and fire damage of the crossfire tube assembly and a reduction in manufacturing cost due to easiness of assembly.

An example of evaluation of the temperature of the guide ring 34A in the crossfire tube assembly (FIG. 6A) according to the second embodiment and the conventional crossfire tube assembly (FIG. 4) is shown in Table 1. In the evaluation, the air having temperature of 260° C. and flow velocity of 20 m/s was fed from an inlet of the inner tube 21 under a condition of the atmospheric pressure, the air having temperature of 10° C. was supplied to the outer tube side, and cooling air was caused to flow in from the air holes. Temperatures of the guide ring 34A were respectively measured in two places of the closed end 36 and the open end 37. Higher temperature was presented. A condition of the length of the annular space 35 is that the length on the closed end 36 side is 29% of the inner diameter of the inner tube 21 and the length on the open end side is 59% of the inner diameter of the inner tube 21. Under the condition, in the configuration of the second embodiment, the obstacle 51 was provided on the outer surface of the guide ring 34A on the open end 37 side of holes of one third of the air holes 33.

In Table 1, in the conventional example (FIG. 4), the temperature at the end portion on the closed end 36 side rose approximately 20° C. compared with the open end 37 side. On the other hand, in the configuration of the second embodiment (FIG. 6A), the temperature on the closed end 36 side fell to temperature equal to or lower than the temperature on the open end 37 side. In the conventional example (FIG. 4), the temperature is considered to have risen compared with the open end 37 side because the air less easily flows to the annular space 35 on the closed end 36 side and cooling in this portion does not proceed. On the other hand, in the configuration of the second embodiment (FIG. 6A), the temperature is considered to have fallen because the obstacle 51 is provided on the outer surface of the guide ring 34A, the air flows to the closed end 36 side, and cooling proceeds.

In this test, the temperature of high-temperature gas flowing into the inner tube 21 is as low as 260° C. However, in an actual gas turbine combustor, high-temperature gas of approximately 1200° C. or more flows in. Therefore, a temperature difference is 100° C. or more. It is predicted that the temperature on the closed end 36 side in the conventional example (FIG. 4) reaches 600° C. or more to be temperature at which fire damage is likely to occur.

TABLE 1

| Target | Temperature of the closed end 36 | Temperature of the open end 37 |
|---|---|---|
| Conventional example (FIG. 4) | 138° C. | 115° C. |
| Second embodiment (FIG. 6A) | 98° C. | 115° C. |

Figure 6B:
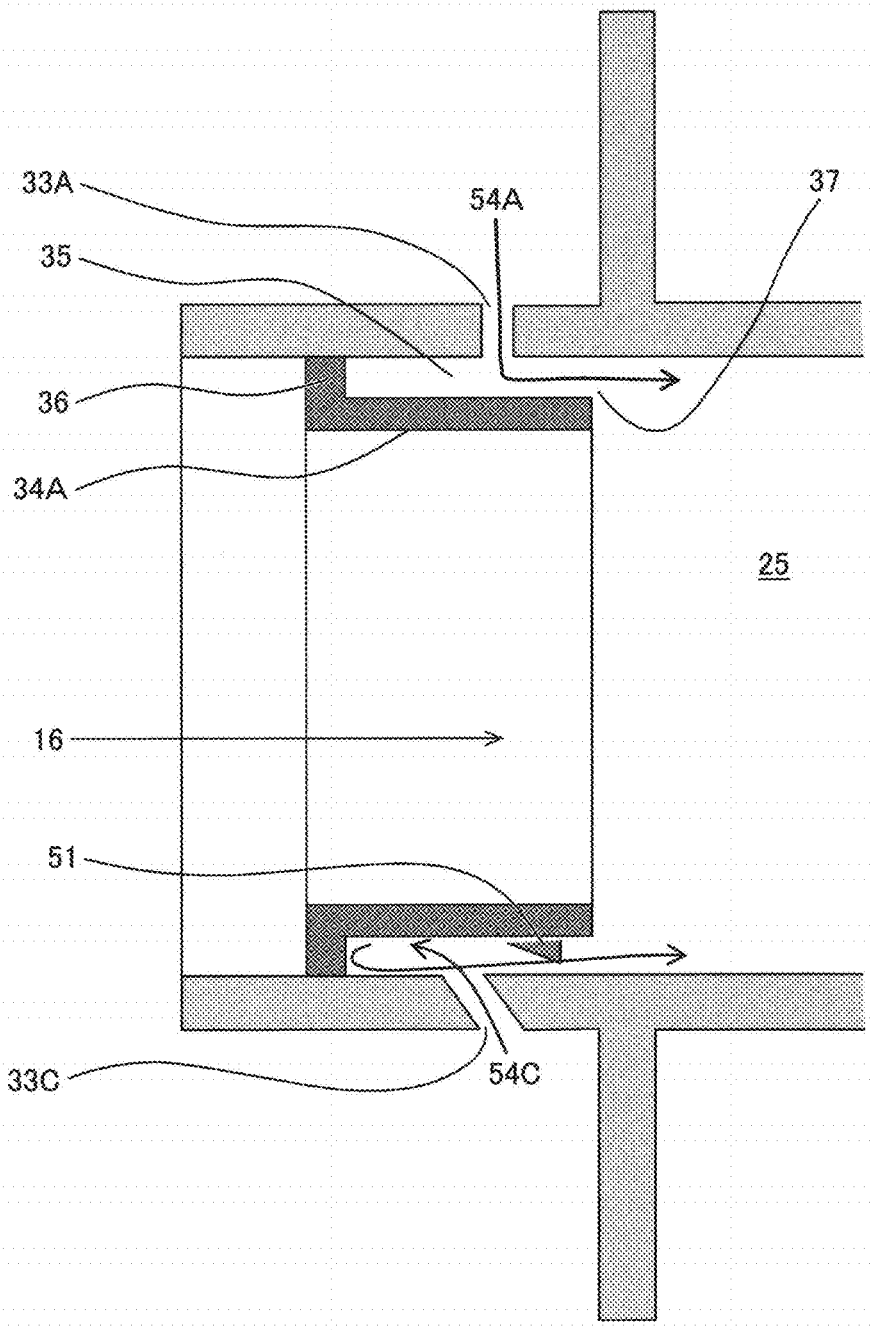
FIG. 6B is a schematic diagram showing the configuration of the air holes for cooling in the crossfire tube assembly according to the embodiment of the present invention.

Note that FIG. 6B is a modification of FIG. 6A and is an embodiment in which both of the air hole 33C drilled to tilt toward the closed end 36 in the first embodiment (FIG. 3A) and the obstacle 51 in the second embodiment (FIG. 6A) are combined. Depending on operation conditions such as the size of the gas turbine combustor and a flow rate of the combustion air, it can be expected to further improve the cooling effect in the annular space 35 by complexly providing the air hole 33C drilled to tilt as shown in FIG. 6B and the obstacle 51 between the air hole 33C and the open end 37.

[Third Embodiment]

Figure 7:
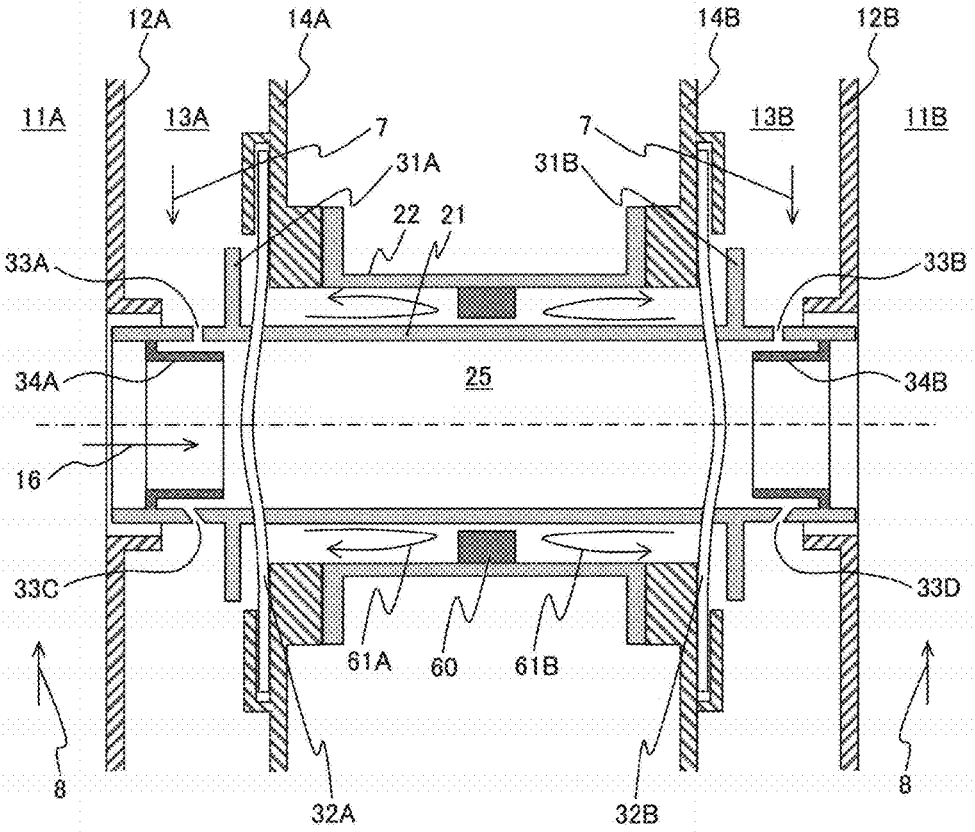
FIG. 7 is a schematic diagram showing the configuration of a crossfire tube assembly according to an embodiment of the present invention.

An example of a gas turbine according to a third embodiment of the present invention is shown in FIG. 7. In the gas turbine shown in FIG. 7, a passage throttling member (a protrusion section) 60 is provided in a space surrounded by the inner tube 21 and the outer tube 22. The passage throttling member 60 narrows the space between the inner tube 21 and the outer tube 22 and, when the combustion air 7 flows, works as resistance to prevent the combustion air 7 from easily flowing between the combustion air channels 13A and 13B.

In FIG. 7, as explained in the first embodiment, the air holes 33C and 33D are respectively provided to tilt to the closed end 36 side. Therefore, as explained above, since the cooling range on the outer surfaces of the guide rings 34A and 34B expands, it is possible to cool the crossfire tube assembly including the guide rings 34A and 34B and reliability is improved. Since it is possible to cool the crossfire tube assembly with a smaller cooling air amount, it is possible to reduce a cooling air amount, cool the crossfire tube assembly without lowering the temperature of the combustion exhaust gas passing through the crossfire tube assembly during ignition, and prevent thermal deformation and fire damage of the crossfire tube assembly. Since margins for fixing of the guide rings 34A and 34B and adjustment of the positions of the guide rings 34A and 34B and the air holes 33 (33A to 33D) are formed by the space on the closed end 36 side of the annular space 35, it is possible to suppress accuracy necessary for machining and machining cost.

Further, in the gas turbine shown in FIG. 7, since the passage throttling member 60 is provided in the space surrounded by the inner tube 21 and the outer tube 22, the combustion air 7 less easily flows between the combustion air channels 13A and 13B. On the other hand, the combustion air 7 flows into the space in the outer tube 22. Therefore, in the outer tube 22, the combustion air forms currents indicated by arrows 61A and 61B. The currents of the air along the surface of the inner tube 21 reverse a flowing direction in the passage throttling member 60 and form circulating currents. The air circulates in the space in the outer tube 22, whereby convection heat transfer is facilitated and cooling of the inner tube 21 proceeds. Note that the passage throttling member 60 can also be applied to the gas turbines according to the first embodiment and the second embodiment. In that case, an effect same as the effect in the third embodiment (FIG. 7) is obtained.

Note that the present invention is not limited to the embodiments explained above and includes various modifications. For example, the embodiments are explained in detail in order to clearly explain the present invention. The embodiments are not always limited to embodiments including all the components explained above. A part of the components of a certain embodiment can be substituted with the components of another embodiment. The components of another embodiment can also be added to the components of a certain embodiment. The other components can be added to, deleted from, and substituted with a part of the components of the embodiments.

DESCRIPTION OF REFERENCE NUMERALS AND SIGNS

1 gas turbine
2 compressor
3A, 3B combustor
4 turbine
5 generator
6 drive shaft
7 combustion air
8 combustion exhaust gas
9A, 9B combustor head portion
10A 10B combustor tail portion
11A, 11B combustion chamber
12A, 12B partition wall (liner)
13A, 13B combustion air channel
14A, 14B outer circumferential partition wall
15 fuel
16 combustion exhaust gas
17 ignitor
20 crossfire tube assembly
21, 21A, 21B inner tube
22 outer tube
23 partition wall of the inner tube
24, 24A, 24B, 24C, 24D current of the air
25 space in the inner tube
26 space between the inner tube and the outer tube
27 center axis of the crossfire tube assembly
31A, 31B stopper
32A, 32B retainer
33, 33A, 33B, 33C, and 33D air hole
34, 34A, 34B guide ring
35 annular space
36 closed end
37 open end
43, 43A, 43B, 43C, 43D air hole
44, 44A, 44B, 44C, 44D current of the air
48 divided portion
51 obstacle (protrusion section)
60 passage throttling member (protrusion section)
61, 61A, 61B current of the air.

The invention claimed is:

1. A gas turbine combustor comprising a plurality of combustors, a first combustor of the plurality of combustors being connected by a crossfire tube assembly to a second combustor of the plurality of combustors, the first combustor having an ignitor for combustion initiation in the first combustor and for ignition in second combustor via the cross fire tube assembly, wherein the crossfire tube assembly includes:

an outer tube, and an inner tube within the outer tube, through which a combustion exhaust gas of the first combustor flows to the second combustor;

the inner tube includes:

a plurality of air holes that introduce a cooling air flow into the inner tube from an outside of the crossfire tube assembly, wherein each of the plurality of air holes have an inlet on an outer diameter of the inner tube and an outlet on an inner diameter of the inner tube; and a guide ring within the inner tube and concentric with the inner tube positioned opposite the plurality of air holes, the guide ring positioned for guiding the cooling air flow introduced by the plurality of air holes along the inner tube, a first end of the guide ring has a flange, the flange connected to the inner diameter of the inner tube such that the flange prevents the cooling air flow from passing through the first end and, a second end of the guide ring, wherein the second end of the guide ring is open to the inner tube such that the cooling airflow can pass into the inner tube, wherein the first end of the guide ring is closer than the second end of the guide ring to the first combustor, wherein a first group of the plurality of the air holes are angled towards the flange such that a portion of the cooling air flow is directed from each outlet of the first group of air holes towards the flange, and a second group of the plurality of the air holes are angled at an angle that is different from the first group of air holes with respect to a central axis of the inner tube.

2. The gas turbine combustor according to claim 1, wherein a distance from each center of the first group of air holes at their respective inlet on the outer diameter of the inner tube to the flange is three times or more as large as a diameter of the first group of air holes.

3. The gas turbine combustor according to claim 1, wherein the inner tube comprises a first cylindrical member and a second cylindrical member, wherein the first cylindrical member is configured to fit into the second cylindrical member.

4. The gas turbine combustor according to claim 1, wherein a protrusion section is provided between the inner tube and the outer tube.

5. A gas turbine combustor comprising a plurality of combustors, a first combustor of the plurality of combustors being connected by a crossfire tube assembly to a second combustor of the plurality of combustors, the first combustor having an ignitor for combustion initiation in the first combustor and for ignition in second combustor via the cross fire tube assembly, wherein the crossfire tube assembly includes:

an outer tube, and an inner tube within the outer tube, through which a combustion exhaust gas of the first combustor flows to the second combustor;

the inner tube includes:

a plurality of air holes that introduce a cooling air flow into the inner tube from an outside of the crossfire tube assembly, wherein each of the plurality of air holes have an inlet on an outer diameter of the inner tube and an outlet on an inner diameter of the inner tube; and a guide ring within the inner tube and concentric with the inner tube positioned opposite the plurality of air holes, the guide ring positioned for guiding the cooling air flow introduced by the plurality of air holes along the inner tube, a first end of the guide ring has a flange, the flange connected to the inner diameter of the inner tube such that the flange prevents the cooling air flow from passing through the first end and, a second end of the guide ring, wherein the second end of the guide ring is open to the inner tube such that the cooling airflow can pass into the inner tube, wherein the first end of the guide ring is closer than the second end of the guide ring to the first combustor, wherein a first group of the plurality of the air holes are angled towards the flange such that a portion of the cooling air flow is directed from each outlet of the first group of air holes towards the flange, and a second group of the plurality of the air holes are angled at an angle that is different from the first group of air holes with respect to a central axis of the inner tube, and a first protrusion section within the guide ring between the plurality of cooling holes and the second end of the guide ring configured to suppress the cooling air flow out the second end of the guide ring.

6. The gas turbine combustor according to claim 5, wherein a distance from each center of the first group of air holes at their respective inlet on the outer diameter of the inner tube to the flange is three times or more as large as a diameter of the first group of air holes.

7. The gas turbine combustor according to claim 5, wherein the inner tube comprises a first cylindrical member and a second cylindrical member, wherein the first cylindrical member is configured to fit into the second cylindrical member.

8. The gas turbine combustor according to claim 5, wherein the plurality of air holes are configured as drilled holes.

9. The gas turbine combustor according to claim 5, wherein a second protrusion section is provided between the inner tube and the outer tube.

* * * * *